US006116174A

United States Patent [19]

Melton

[11] Patent Number: 6,116,174

[45] Date of Patent: Sep. 12, 2000

[54] APPARATUS FOR FRAMING FABRICS IN HOOPS

[76] Inventor: Jo Ann Melton, 938 N. County Rd. 575 West, Richland, Ind. 47634

[21] Appl. No.: 09/184,172

[22] Filed: Nov. 2, 1998

Related U.S. Application Data

[60] Provisional application No. 60/064,974, Nov. 10, 1997.

[51] Int. Cl.[7] ..... D05C 9/22; D06C 3/08

[52] U.S. Cl. ..... 112/103

[58] Field of Search ..... 38/102, 102.29, 38/102.91; 112/103; 269/79, 303

[56] References Cited

U.S. PATENT DOCUMENTS

| | | | |
|---|---|---|---|
| 4,466,601 | 8/1984 | Raines | 269/79 |
| 4,545,127 | 10/1985 | Barry | 33/180 R |
| 4,767,111 | 8/1988 | Guenther | 269/303 |
| 4,774,778 | 10/1988 | Williams | 38/102.2 |
| 5,433,158 | 7/1995 | Moore, III | 39/102.2 |
| 5,934,210 | 8/1999 | Lucchese | 38/102.2 X |

*Primary Examiner*—Ismael Izaguirre
*Attorney, Agent, or Firm*—George Morgan

[57] ABSTRACT

The present invention is an apparatus for and a method of framing fabrics in hoops comprising a board, a jig, grooves, apertures, and pins. The jig, while holding a hoop, is located off of one or more of the grooves and then held in position by pegs. The fabric to hooped is placed over the hoop and then constrained in the hoop by an inner hoop. The hoops with the fabric are then removed from the jig for the intended embroidery work. The board is also useful for positioning a fabric prior to assembly in a garment. The board is also applicable for positioning appliques.

2 Claims, 4 Drawing Sheets

APPARATUS FOR FRAMING FABRICS IN HOOPS

This Application claims the benefit of U.S. Provisional No. 60/064,974 filed Nov. 10, 1997.

CROSS REFERENCES TO RELATED APPLICATIONS

NONE

Statement as to Rights to inventions made under Federally sponsored research and development Not applicable

BACKGROUND OF THE INVENTION

1. Field of the Invention

This invention relates to the framing of fabric portions in hoops as an aid to embroidery work.

2. Background Information

Apparatus for the framing of garment portions in hoops as an aid to embroidery work exist. An example is U.S. Pat. No. 4,767,111 by Guenther, Aug. 30, 1988 which is very popular with commercial embroideriers. However, existing apparatus, such as Guenther, are available only as a specific model for a specific commercial embroidery machine. Each embroidery machine has an attachment for mounting the hoop that is peculiar to the given manufacturer. The Guenther sells each model for a specific machine brand. There is quite a variety of such machine brands in existance. If a club of embroidery enthusists wanted to pool their resources to buy a Guenther, it would only be suitable for one specific embroidery machine. If they are using sewing machines with embroidery attachments, Guenther is not available. If members of the club had different embroidery machines, they would need as many different models of the Guenther as they had different brands of embroidery machines. Also, the Guenther requires two boards, one for the front of a blouse or shirt, and one for the back of the blouse or shirt. This is quite efficient for a production shop. However, there is a need for a more universal apparatus for the framing of garment portions in hoops that is simple to use, suitable for individuals and non-commercial embroideriers.

As will be seen in the subsequent description, the preferred embodiment of the present invention overcomes these and other deficiencies in existing apparatus for framing fabrics in hoops.

SUMMARY

The present invention is an apparatus for and a method of framing a fabric in hoops. It features a simple board, usable for fabrics in general, and specifically for both the front and back of garments, including blouses and shirts, in conjunction with a jig that holds a hoop that is used to frame the garment portion. It is applicable, but not restricted to fabrics such as napkins, tablecloths, totebags, garment bags, and towels. The jig is designed to hold a given hoop for a given embrodiery machine or a sewing machine with embroidery attachment. Each hoop has a bracket specific to the embroidery machine or sewing machine with embroidery attachment it came from. So by having a jig that adapts from the board to a given hoop, each member of a group of individual embroideriers can purchase an inexpensive jig to match the board owned in common. The board includes a simple system for jig positioning that includes at least one positioning grooves as well as sleeved holes to which the jig is pinned once a location is selected. The hoops can also be manually embroideried, as opposed to machine embroideried. Also the board is useful for positioning fabrics prior to assembly into garments for a variety of alignments. An example is using a grove for positioning a skirt for hemming. Apertures in the board are useful for positioning appliques such as a pocket on a garment.

Figure 1:
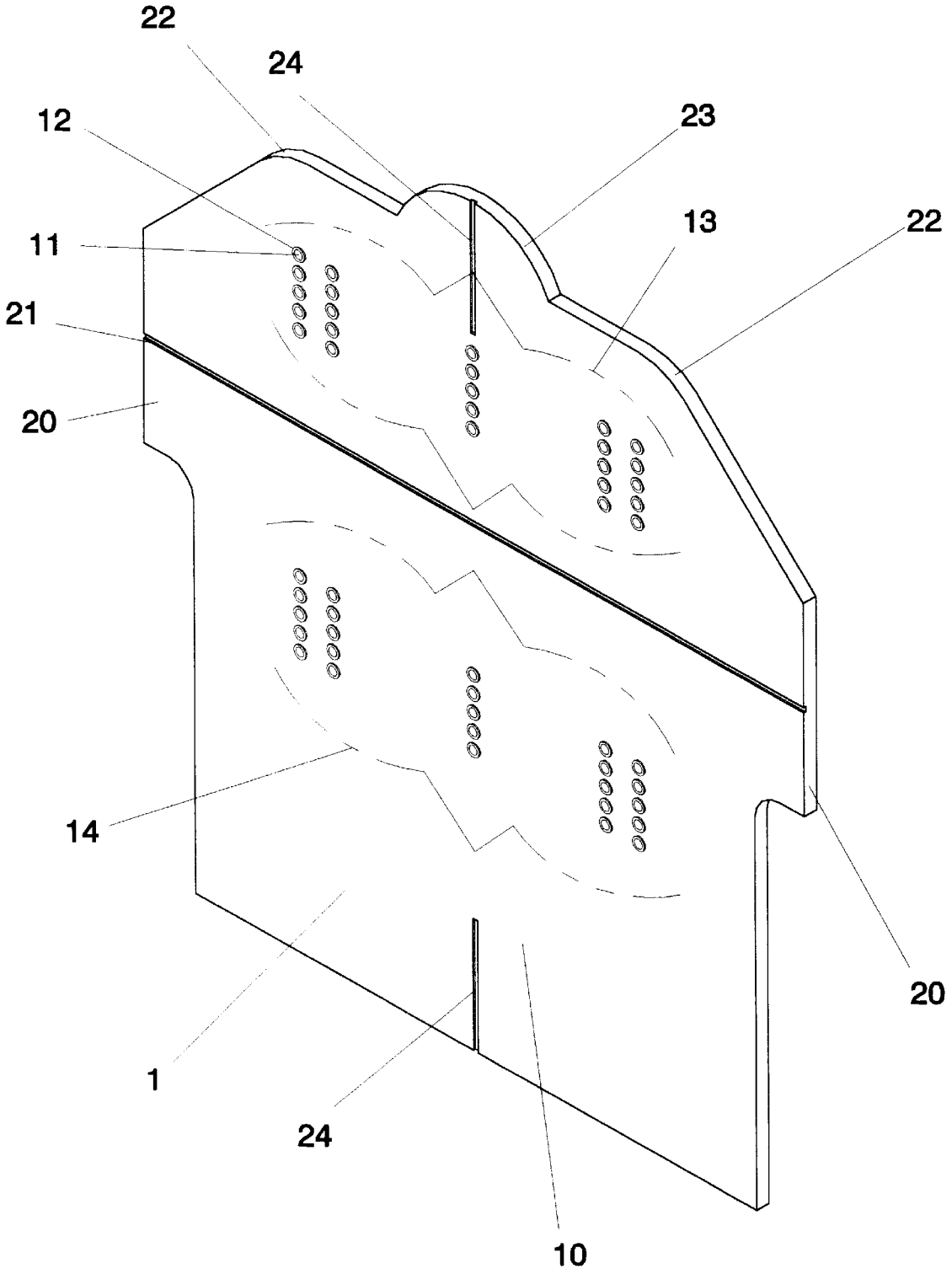
FIG. 1 shows a board, which is a part of the preferred embodiment of the present invention.
Figure 2:
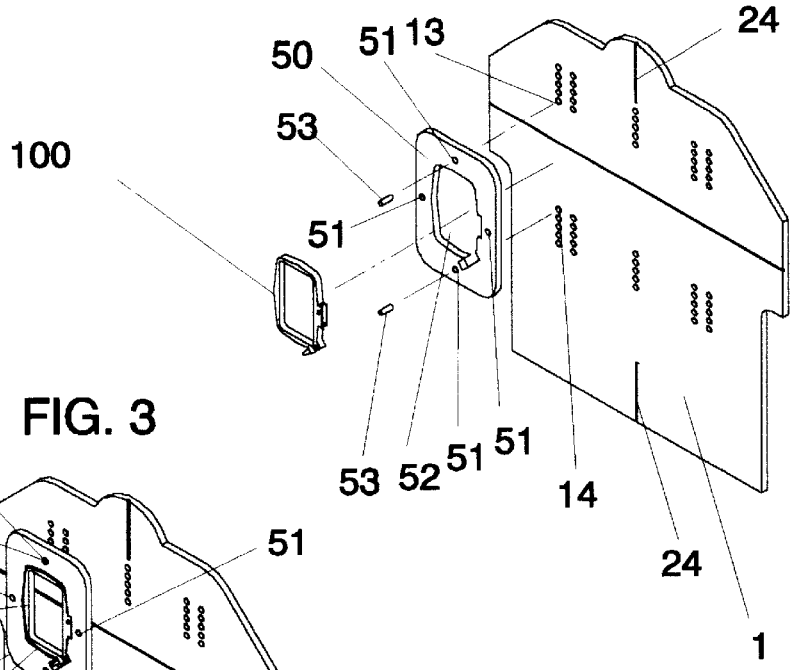
FIG. 2 shows an exploded view of the preferred embodiment of the present invention.

DESCRIPTION OF THE PREFERRED EMBODIMENTS:

Referring to FIGS. 1 and 2 the preferred embodiment of the present invention, an apparatus for framing fabrics in hoops, a hooper 1 is shown. The hooper 1 comprises a board 10 with sleeve extensions 20, simulated shoulders 22, a simulated neck 23, least one vertical centering groove 24 which is preferrably bisecting the simulated neck 23, a horizontal groove 21 which is preferrably bisecting the simulated shoulders 22, upper mount apertures 13, and lower mount apertures 14, a jig 50, and pegs 53.

Figure 8:
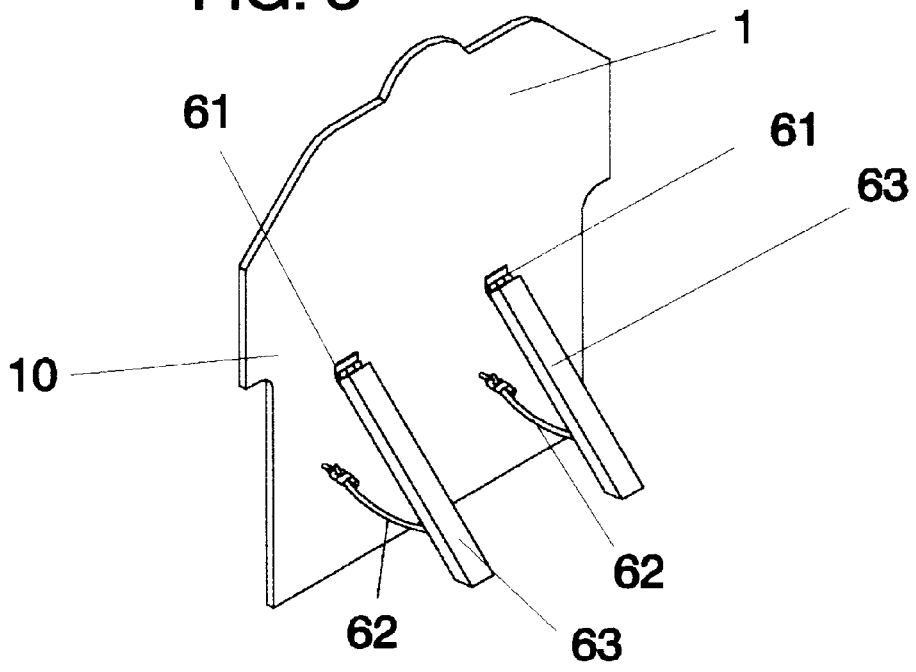
FIGS. 8 and 9 are back views of embodiments of the present invention.
Figure 9:
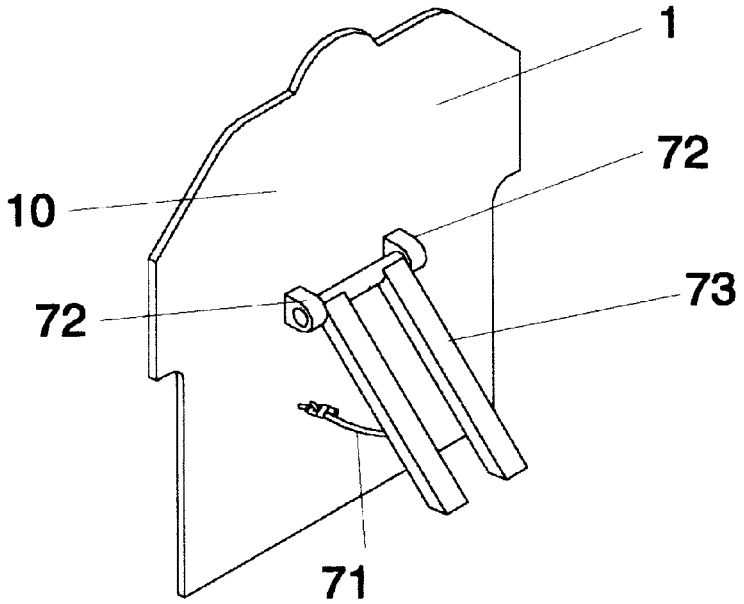

In the preferred embodiment of the present invention, the hooper 1 further comprises a means of maintaining the board 10 in an upright position as indicated in FIG. 8 or FIG. 9. In FIG. 8 the hooper 1 is maintained in an upright position by means of at least one support leg 63 attached to a hinge 61 which is attached to the back of the board 10, said support leg 63 also attached to the board 10 by a means for limiting outward travel of the support leg 63 such as a flexible tension member 62. As obvious to anyone skilled in the art, a cable, chain, or rope would serve the purpose.

In FIG. 9, the hooper 1 is maintained in an upright position by means of a support leg assembly 73 mounted in pivot blocks 72 which are attached to the board 10, wherein the support leg assembly 73 is also connected to the board 10 by means of an alternate flexible tension member 71. As obvious to anyone skilled in the art, a cable, chain, or rope would serve the purpose.

In the preferred embodiment of the present invention, the board 10 would be wood. But, as obvious to anyone skilled in the art, other materials such as MASONITE, plastic, or metal might serve the same purpose.

In the preferred embodiment of the present invetion, the upper mount apertures 13 and the lower mount apertures 14 are achieved by the insertion of sleeves 12 in clearances 11 as shown in FIG. 1. In the preferred embodiment of the present invention, the sleeves 12 are brass eyelets so as to minimize wear from the insertion of the pegs 53, which are typically stainless steel.

Figure 3:
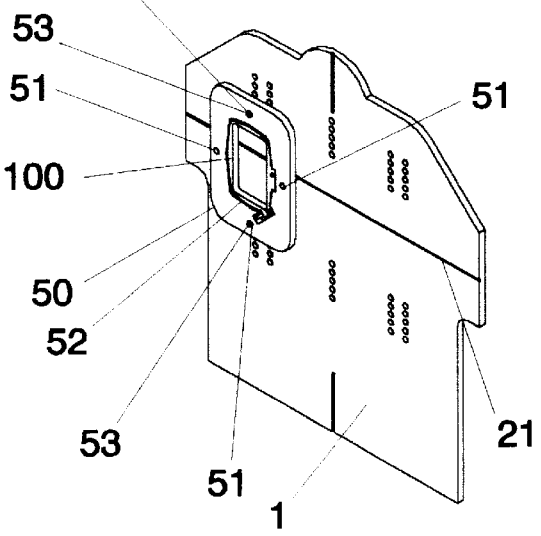
FIG. 3 is a view of the preferred embodiment of the present invention where an outside hoop is contained in a jig pinned in position on the board.
Figure 4:
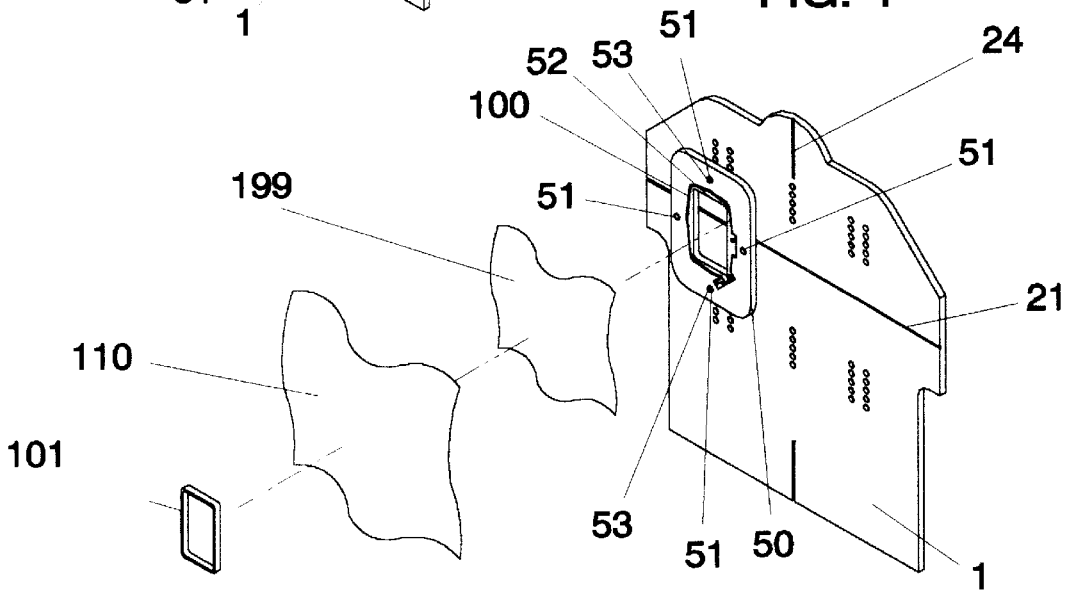
FIG. 4 is an illustration of the present invention as a fabric is positioned to be secured by an inside hoop to the outside hoop contained in the jig.

A purpose of the invention, the hooper 1, as indicated in FIGS. 3 and 4, is to enable an embroidrier to position a fabric 110 within the prior art hoop 100 so that an embroidery machine, or a sewing machine with an embrodiery attachment can then embroidery a fabric 110 when contained within the hoops 100 and 101 in the position selected by the embroiderier. Referring to FIGS. 3 and 4, the jig 50 is positioned on the board 10 with respect to the one or more of the grooves 21 and 24. The grooves serve as visual or tactile aids for the assistance of the embrodierier in positioning the jig 50 which will hold the hoops 100 and 101 which will constrain a fabric 110 in position. The hooping and attachment frame 50 is secured in position with the pegs 53. A prior art outside hoop 100 that mates with the jig 50 is placed into the jig 50. A paper backing known in the embroidery trade as a stabilizer 199 is placed over the prior art outside hoop 100 contained by the jig 50. The fabric 110 is placed over the board 10, over the stabilizer 199. A relatively small fabric 110 is shown in FIG. 4 for simplicity of illustration.

The the board 10 as illustrated in FIG. 1 is especially applicable garments, including, but not restricted to shirts, blouses, jumpers, jackets, and sweat shirts, both fronts and backs. blouses, both front and back sides. The sleeve extensions 20 in combination with the shoulders 22 serve a functional purpose in that a sleeve seam can be positioned off of the appropriate sleeve extension 20, according to whether it is a left seam or a right seam, in conjunction with the adjacent shoulder 22, especially for 2X and 3X sized garments. An alternate embodiment of the present invention need not incorporate the sleeve extensions 20. Such an alternate embodiment would be adequate for many infant sizes as well as other types of garments or fabrics.

Figure 5:
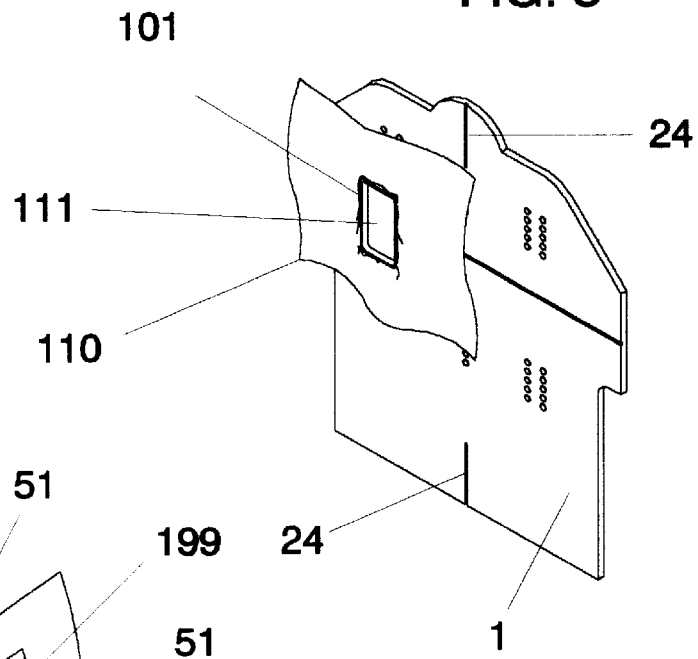
FIG. 5 is an illustration of the fabric contained within the hoops in the jig.
Figure 6:
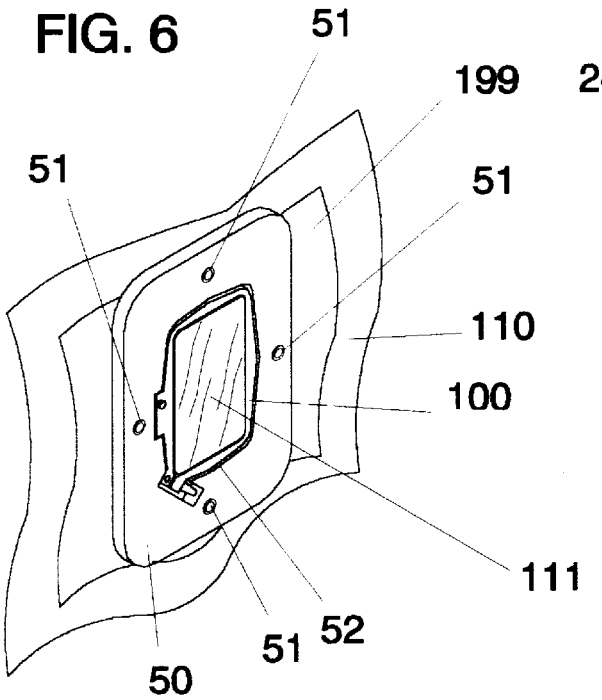
FIG. 6 illustrates a view of the jig with the hoops containing the fabric as it would appear from the board side.
Figure 7:
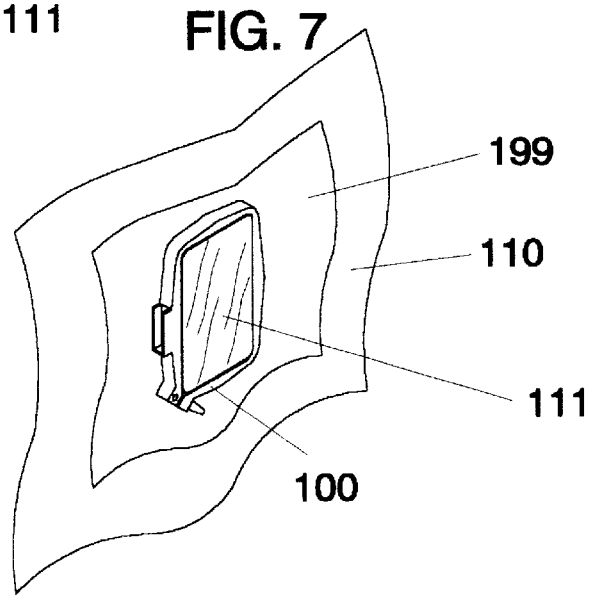
FIG. 7 illustrates the fabric contained in the hoops after removal from the jig, the hoops ready to be inserted into an embroidery machine or sewing machine with embroidery attachments.

Referring also to FIGS. 5, 6, and 7, a prior art inside hoop 101, that mates with the prior art outside hoop 100 in place, is inserted into the prior art outside hoop 100, constraining the fabric 110 and the stabilizer 199 within the hoops 100 and 101. The fabric 110 and stabilizer 199 are then removed, with the hoops 100 and 101, from the jig 50. The hoops 100 and 101 are in place on the fabric 110, holding the fabric 110 with the stabilizer 199 in position in the hoops 100 and 101 for embroidery in an area 111 as indicated in FIG. 5, 6, and 7. The hoops 100 and 101 can now be inserted into an embroidery machine, a sewing machine with an embroidery attachment, or holder for manual embroidery.

In the preferred embodiment of the present invention, the clearances 11 are not through clearances, as can be seen by the views of the board 10 in FIGS. 8 and 9.

The hooper 1 permits the use of a variety of jigs 50 to adapt to a variety of the hoops 100 and 101 which are each unique for a given embroidery machine or sewing machine embroidery attachment as opposed to requiring a specific hooper for each embroider machine or sewing machine embrodiery attachment as is now current art.

By the use of jigs such as jig 50 to adapt machine specific hoops such as 100 and 101 to a hooper 1 which has a board 10, a group of embrodriers with a variety of embroidery machines or sewing machines with embroidery attachments can now use one hooper 1 as opposed to needing a specialized hooper for each of the variations of embroidery attachments.

The jig 50 is typically wood, but as obvious to anyone skilled in the art other materials such as MASONITE, plastics, or aluminum could serve the same purpose. The pegs 53 are typically metal such as steel, brass, or aluminum although a suitable plastic would suffice as an alternative material.

Also, the board 10 is useful for positioning fabrics prior to assembly into a garment for a variety of sewing alignments. One such example, is the use of the horizontal groove 21 for positioning a skirt for hemming. The apertures 13 and 14 are useful of positioning appliques. An applique, in the sewing trade is another fabric to be sewn on a first fabric, such as a pocket on a garment.

Although the description above contains many specificities, these should not be construed as limiting the scope of the invention but as merely providing illustrations of some of the presently preferred embodiments of this invention. For example, the stabilizer 199 is mentioned as a part of the process of hooping a fabric 200. As obvious, to anyone skilled in the art, a fabric 200 can be hooped without the stabilizer 199, it is just that the embroidery results may not be as satisfactory. Also, pegs 53 in conjunction with eyelets 12 work satisfactorly in holding the jig 50 in position on the board 10. As obvious to anyone skilled in the art, headed pegs with through clearances would also accomplish the intended purpose of holding the jig 50 in position on the board 10 while holding the fabric 200.

Thus the scope of the invention should be determined by the appended claims and their legal equivalents, rather than by the examples given.

I claim:

1. A device for framing a fabric in hoops, said device being applicable to positioning a fabric prior to assembly in a garment, said device comprising:

a) a jig which serves to hold a hoop;

b) at least one peg for holding said jig to a board; and c) said board comprising at least one groove, said groove serving as a visual or tactile aide in positioning said jig on said board, and apertures into which said at least one peg is insertable for holding said jig on said board.

2. The device for framing a fabric in a hoop of claim 1 wherein said device is applied to positioning appliques.

* * * * *